US008857737B2

(12) United States Patent
Chen

(10) Patent No.: US 8,857,737 B2
(45) Date of Patent: Oct. 14, 2014

(54) SPRAYING DEVICE

(75) Inventor: Chin-Nan Chen, New Taipei (TW)

(73) Assignee: Strong Fortress Tool Co., Ltd., New Taipei (TW)

( * ) Notice: Subject to any disclaimer, the term of this patent is extended or adjusted under 35 U.S.C. 154(b) by 512 days.

(21) Appl. No.: 13/245,517

(22) Filed: Sep. 26, 2011

(65) Prior Publication Data

US 2013/0056558 A1 Mar. 7, 2013

(30) Foreign Application Priority Data

Sep. 1, 2011 (TW) ..... 100216341

(51) Int. Cl.

| | |
|---|---|
| ***A62C 13/62*** | (2006.01) |
| ***B05B 3/06*** | (2006.01) |
| ***B05B 7/24*** | (2006.01) |
| ***B08B 3/02*** | (2006.01) |
| *B05B 1/26* | (2006.01) |

(52) U.S. Cl.

CPC ..... *B05B 7/2454* (2013.01); *B05B 3/06* (2013.01); *B08B 3/028* (2013.01); *B05B 1/265* (2013.01)

USPC ..... 239/302; 239/371

(58) Field of Classification Search

CPC ..... B05B 7/0869; B05B 7/0433; B05B 7/063

USPC ..... 239/302, 327, 344, 366, 368, 416.5, 239/417, 600, 371

See application file for complete search history.

(56) References Cited

U.S. PATENT DOCUMENTS

| | | | | |
|---|---|---|---|---|
| 2,067,328 | A * | 1/1937 | Lux | 422/263 |
| 2,827,329 | A * | 3/1958 | Bullock | 239/344 |
| 3,191,869 | A * | 6/1965 | Gilmour | 239/318 |
| 3,231,200 | A * | 1/1966 | Heald | 239/318 |

* cited by examiner

*Primary Examiner* — Davis Hwu

(74) *Attorney, Agent, or Firm* — Cheng-Ju Chiang

(57) ABSTRACT

A spraying device includes a rotatable outer fluid transmission tube and an inner fluid transmission tube disposed in the outer fluid transmission tube. A friction reducing layer, rotated together with the outer fluid transmission tube, is provided between the outer fluid transmission tube and the inner fluid transmission tube. The friction reducing layer is made of a material having a low friction coefficient and has a smooth inner wall surface, so as to make a friction force between the friction reducing layer and the inner fluid transmission tube lower and improve the durability of the inner fluid transmission tube.

8 Claims, 4 Drawing Sheets

SPRAYING DEVICE

FIELD OF THE INVENTION

The present invention relates to a spraying gun, and more particularly to a spraying device having a reduced friction force between an outer fluid transmission tube thereof and an inner fluid transmission tube thereof.

BACKGROUND OF THE INVENTION

Many spraying guns have been used widely for cleaning dust and dirt from a surface of an object, for watering, for spraying paint, and the like. The spraying guns remove dust and dirt by spraying a high pressure fluid, and perform watering and spraying paint with the use of a high pressure fluid mixed with water or other spraying liquid.

In a conventional prior art, a high pressure fluid is introduced into the spraying gun and is then sprayed out from an outer transmission tube of the spraying gun. An inner transmission tube, which has a cross section area smaller than that of the outer transmission tube, is provided in the outer transmission tube. When the high pressure fluid is sprayed out of the outer transmission tube, Venturi effect is induced at an outlet of the inner transmission tube, it makes a spraying liquid be sprayed out from the inner transmission tube.

In order to uniform the spraying distribution, the outer transmission tube of the spraying gun is made to have a bending shape and in rotation when driving. The inner transmission tube disposed in the outer transmission tube is made of a flexible material, so as to be deformed by bending with the rotation of the outer transmission tube. Thus, a mixed fluid of the high pressure fluid and spraying liquid will be spraying uniformly in every direction with the rotation of the outer transmission tube. However, with the increasing time duration in use of the spraying gun, the inner transmission tube may be worn down or broken due to friction to the outer transmission tube, that result in reducing of durability and parts replacement with increasing frequency.

SUMMARY OF THE INVENTION

In view of the above circumstances that the spraying gun in a conventional prior art has low durability, that results in parts replacement with increasing frequency and inconvenient in use.

Therefore, it is an object of the present invention to provide a spraying device in which a friction force between the outer transmission tube and the inner transmission tube is low so as to improve the durability of the inner transmission tube and to reduce frequency of parts replacement.

The present invention overcomes the drawbacks of the prior art, and provides a spraying device comprising: an outer fluid transmission tube which is disposed in the spraying device and is rotatable with an axial of the spraying device, the outer fluid transmission tube being in fluid communication with a fluid input tube which is used for connecting to a fluid supplying source; and an inner fluid transmission tube, used for connecting to a fluid container, being disposed in the outer fluid transmission tube, wherein a friction reducing layer, made of a material having a low friction coefficient, is provided between the outer fluid transmission tube and the inner fluid transmission tube and is rotated together with the outer fluid transmission tube, and an inner wall surface thereof is formed as with a smooth surface, so as to make a friction force between the friction reducing layer and the inner fluid transmission tube lower.

In a preferred embodiment of the present invention, the material having a low friction coefficient is a polytetrafluoroethylene material.

In a preferred embodiment of the present invention, the inner fluid transmission tube is made of a material having a low friction coefficient.

In a preferred embodiment of the present invention, the friction reducing layer is a tube.

In a preferred embodiment of the present invention, the friction reducing layer is a film coated on an internal surface of the outer fluid transmission tube.

In a preferred embodiment of the present invention, a bump is formed on an internal surface of the outer fluid transmission tube for blocking an end portion of the friction reducing layer.

In a preferred embodiment of the present invention, the outer fluid transmission tube has a conveying section and a bend output section connected with the conveying section, and the friction reducing layer is provided extending along the bend output section.

In a preferred embodiment of the present invention, the outer fluid transmission tube has a conveying section and a bend output section connected with the conveying section, and the friction reducing layer is provided extending along both the conveying section and the bend output section.

Thereby, the inner fluid transmission tube does not directly contact with the outer fluid transmission tube but the friction reducing layer so as to prevent the friction between the inner fluid transmission tube and the fluid outer transmission. Further, the friction to the inner fluid transmission tube can be reduced by material and structure of the friction reducing layer, so that the durability of the inner fluid transmission tube is improved and frequency of parts replacement for the inner fluid transmission tube is reduced.

In additional, the friction reducing layer in an embodiment of the present invention is a tube, which is easy in manufacturing due to its simple structure. The friction reducing layer also has practicality in disposing because it can be assembled with the fluid outer transmission conveniently and quickly.

BRIEF DESCRIPTION OF THE DRAWINGS

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
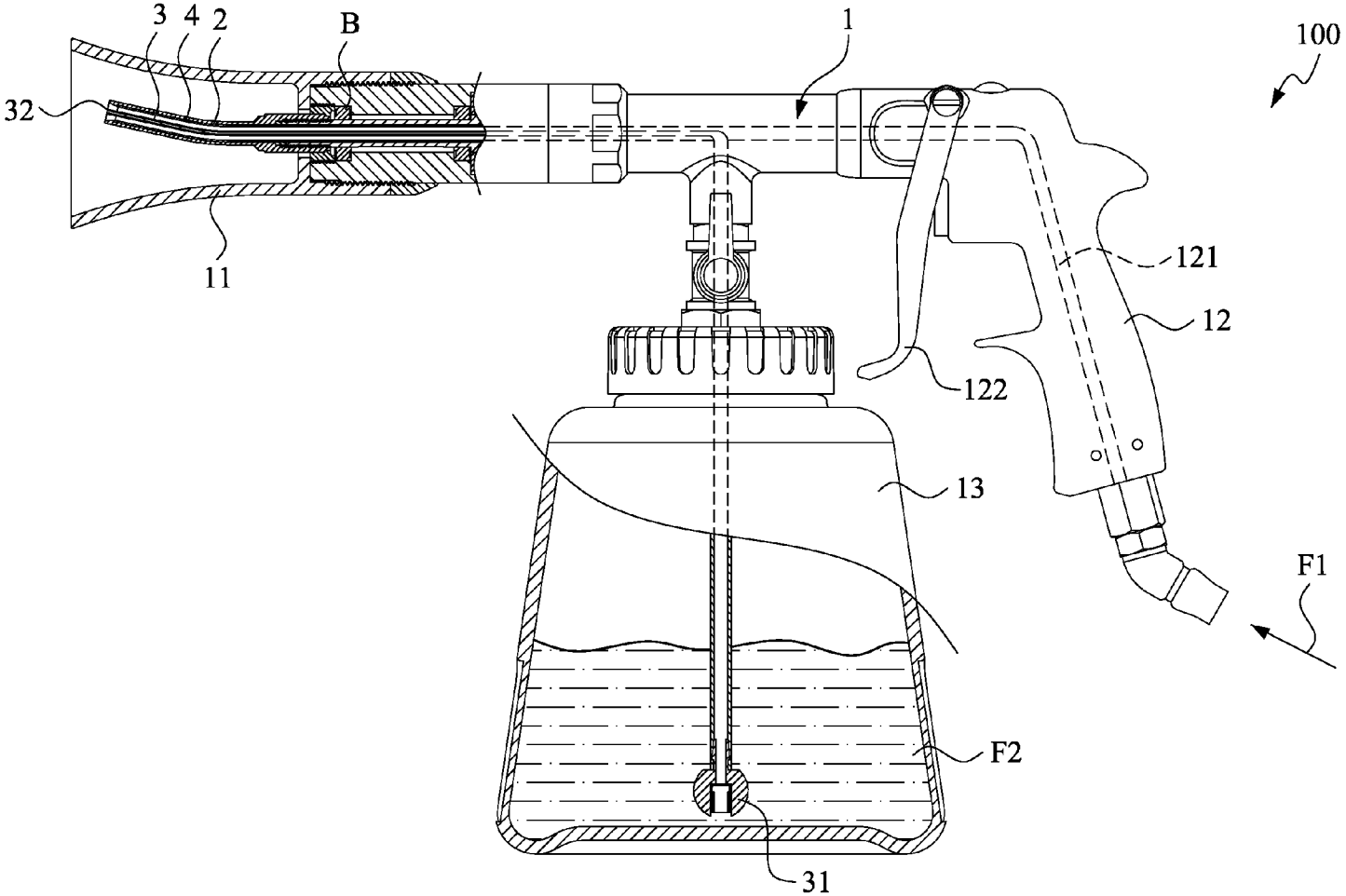
FIG. 1 is a cross-section view of a spraying device according to an embodiment of the present invention.
Figure 2:
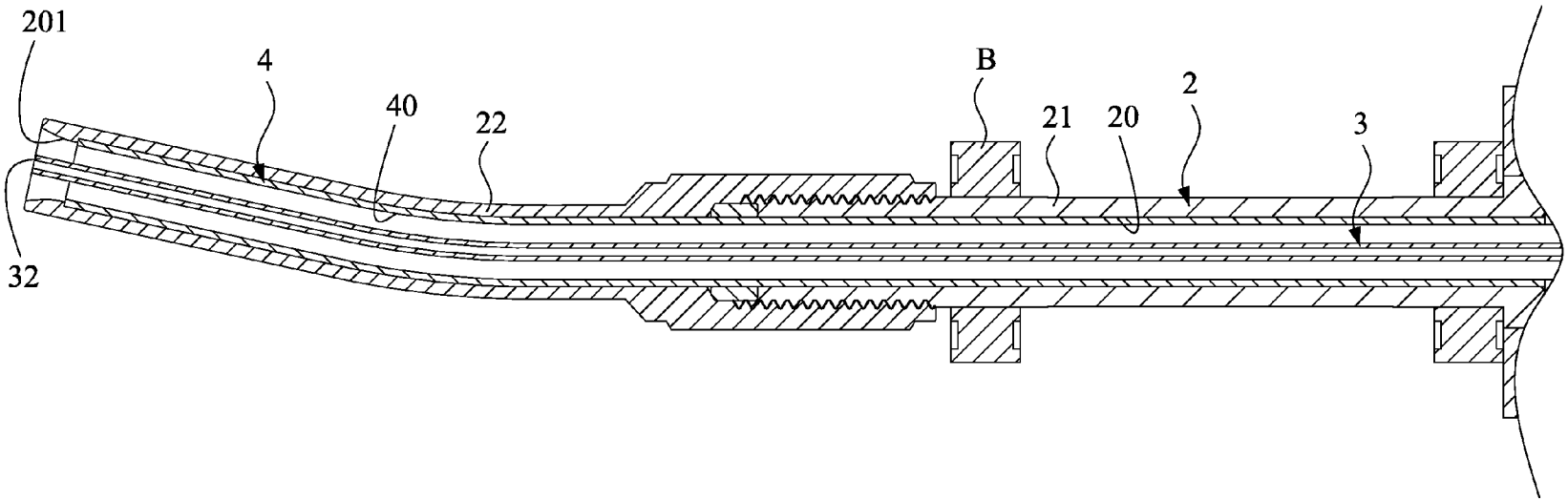
FIG. 2 is a partial enlarged view of FIG. 1.
Figure 3:
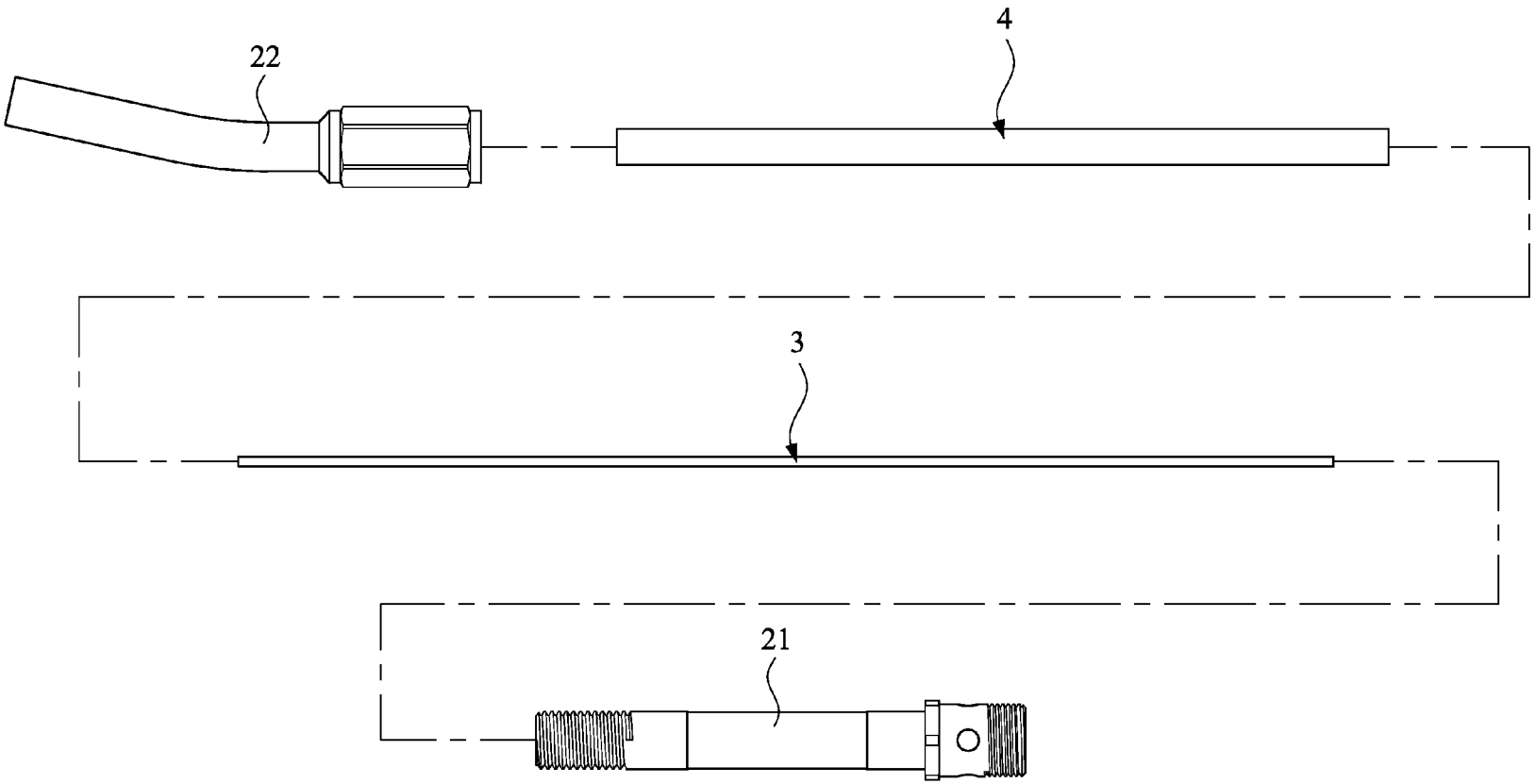
FIG. 3 is a partial explosion diagram of FIG. 1.

Please refer to FIGS. 1-3. FIG. 1 is a cross-section view of a spraying device according to an embodiment of the present invention, FIG. 2 is a partial enlarged view of FIG. 1, and FIG. 3 is a partial explosion diagram of FIG. 1.

As shown in FIGS. 1-3, a spraying device 100 according to an embodiment of the present invention includes a body 1. The body is provided at one end thereof with a spraying head 11, the other end thereof with a control handle 12, and a lower portion thereof being assembled with a fluid container 13.

An outer fluid transmission tube 2, provided in the body 1, is assembled to the body 1 with a bearing B, so as to rotate with an axial of the spraying device 100. Certainly, there are many structures that enable the outer fluid transmission tube 2 to be rotatable with the body 1, for example, a structure in which the outer fluid transmission tube 2 is combined with a motor, a fan, or the like may be given.

The outer fluid transmission tube 2 has a conveying section 21 having a linear shape and a bend output section 22 having a bent shape. The conveying section 21 of the outer fluid transmission tube 2 is in fluid communication with a fluid input tube 121 disposed in the control handle 12. The fluid input tube 121 is used for connecting to a fluid supplying source (not shown), so as to enable a fluid F1 from the fluid supplying source being conveyed to the outer fluid transmission tube 2 through the fluid input tube 121. In addition, a regulating means 122, which functions as a valve, is further provided in the control handle 12 to regulate the flow rate of the fluid F1 input from the fluid input tube 121 to the outer fluid transmission tube 2, or to prevent the fluid F1 from flowing into outer fluid transmission tube 2 by closing the valve. The bend output section 22 is formed extending to the spraying head 11 so that the fluid F1 may be sprayed along a bending direction of the bend output section 22 when the outer fluid transmission tube 2 is rotated.

An inner fluid transmission tube 3 is disposed in the outer fluid transmission tube 2. The inner fluid transmission tube 3 is provided with an input end 31 thereof in fluid communication with the fluid container 13 so as to convey a contained fluid F2 contained in the fluid container 13, and an output end 32 thereof extending in proximity to an outlet of the outer fluid transmission tube 2. With such structure, when the fluid F1 is sprayed from the outlet of the outer fluid transmission tube 2, Venturi effect is induced at the output end 32 of the inner fluid transmission tube 3. This effect makes the contained fluid F2 contained in the fluid container 13 be sucked into the inner fluid transmission tube 3 through the input end 31 thereof and then output from the output end 31 of the inner fluid transmission tube 3.

A friction reducing layer 4 is provided between the outer fluid transmission tube 2 and the inner fluid transmission tube 3. The friction reducing layer 4 is a tube, which is disposed in the outer fluid transmission tube 2. However, the present invention is not limited to this, and the friction reducing layer 4 may be a film coated on an internal surface 20 of the outer fluid transmission tube 2. Further, the friction reducing layer 4 is fixed to the outer fluid transmission tube 2 so that the friction reducing layer 4 is rotated together with the outer fluid transmission tube 2 when the outer fluid transmission tube 2 rotates with the axial of the spraying device 100. Therefore, there is no friction occurs between the friction reducing layer 4 and the outer fluid transmission tube 2, and the possibility of wearing down or break is thus reduced.

The friction reducing layer 4 is made of a material having a low friction coefficient, such as a polytetrafluoroethylene (PTFE) material having a low friction coefficient of 0.05-0.10, and an inner wall surface thereof is formed to be a smooth surface, so as to make a friction force between the friction reducing layer 4 and the inner fluid transmission tube 3 lower. By that, the inner fluid transmission tube 3 does not directly contact with the outer fluid transmission tube 2 but the friction reducing layer 4 when deformed by bending with the rotation of the outer fluid transmission tube 2. In the other hand, it has a very low friction force between the inner fluid transmission tube 3 and the friction reducing layer 4, so that the inner fluid transmission tube 3 is not easy to be worn down or broken even if with the increasing time duration in use. By providing the friction reducing layer 4, durability of the inner fluid transmission tube 3 is improved and frequency of parts replacement for the inner fluid transmission tube 3 is reduced.

Preferably, the inner fluid transmission tube 3 may be made of a material having a low friction coefficient, such as a polytetrafluoroethylene (PTFE) material. Thereby, it effectively prevents the friction reducing layer 4 from being worn down or breaking due to friction by the inner fluid transmission tube 3, and durability of the friction reducing layer 4 is thus improved.

In addition, in order to prevent the friction reducing layer 4 from separating from the outer fluid transmission tube 2, a bump 201 is formed on the internal surface 20 of the outer fluid transmission tube 2 for blocking an end portion of the friction reducing layer 4. The effect of the bump 201 is to prevent the friction reducing layer 4 from coming off the outer fluid transmission tube 2 due to the centrifugal forces generated by rotation of the outer fluid transmission tube 2.

Figure 4:
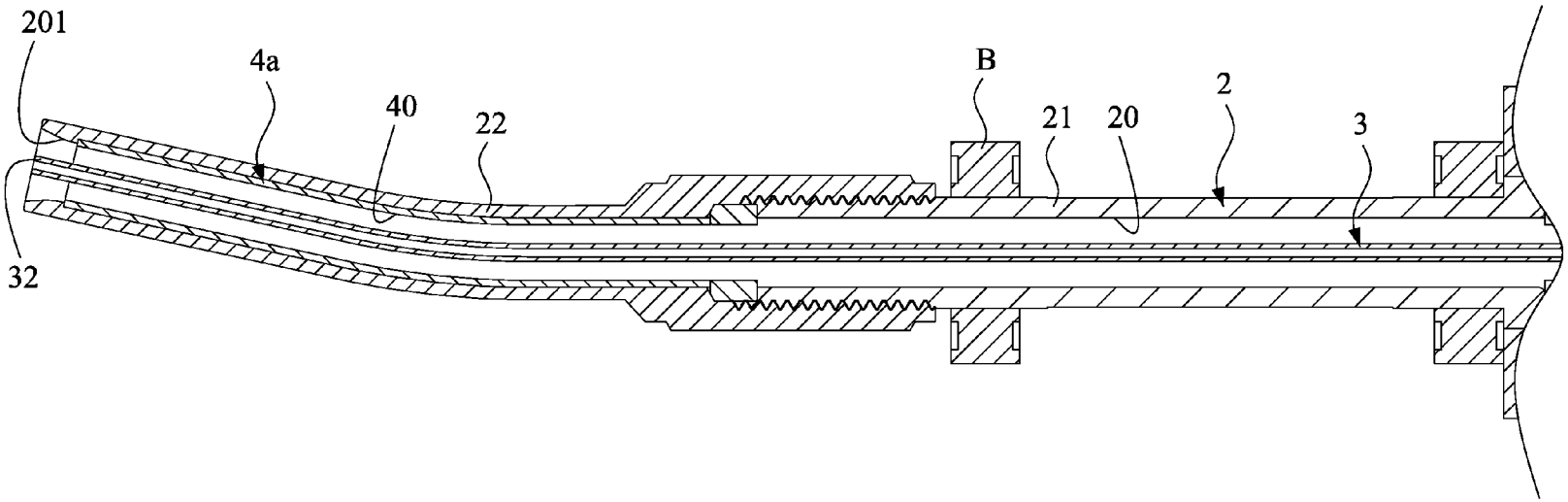
FIG. 4 is a cross-section view of a spraying device according to another embodiment of the present invention.

In this embodiment, the friction reducing layer 4 is provided extending along both the conveying section 21 and the bend output section 22 of the outer fluid transmission tube 2, so as to prevent contact between the inner fluid transmission tube 3 and the outer fluid transmission tube 2. Besides, a friction reducing layer 4*a* may be provided extending along the bend output section 22. That is, there is no friction reducing layer provided on the conveying section 21, as shown in FIG. 4. Because longitudinal axis of the conveying section 21 is coaxial with the rotation axis but that of the bend output section 22 is not, friction between the inner fluid transmission tube 3 and the outer fluid transmission tube 2 almost occurs at the bend output section 22. Therefore, the friction force between the inner fluid transmission tube 3 and the outer fluid transmission tube 2 can be reduced effectively by providing the friction reducing layer 4*a* on only the bend output section 22, and cost of the friction reducing layer 4*a* can be decreased with its reduced length.

As can be appreciated from the above embodiments, the spraying device of the present invention has industry worth which meets the requirement for a patent. The above description should be considered as only the discussion of the preferred embodiments of the present invention. However, a person having ordinary skill in the art may make various modifications to the present invention. Those modifications still fall within the spirit and scope defined by the appended claims.

What is claimed is:

1. A spraying device comprising: an outer fluid transmission tube which is disposed in the spraying device and is rotatable with an axial of the spraying device; the outer fluid transmission tube being in fluid communication with a fluid input tube which is used for connecting to a fluid supplying source; and an inner fluid transmission tube, used for connecting to a fluid container, being disposed in the outer fluid transmission tube, wherein a friction reducing layer, made of a material having a low friction coefficient, is provided between the outer fluid transmission tube and the inner fluid transmission tube and is rotated together with the outer fluid transmission tube, and an inner wall surface thereof is formed as with a smooth surface, so as to make a friction force between the friction reducing layer and the inner fluid transmission tube lower;

wherein the outer fluid transmission tube has a conveying section and a bend output section connected with the conveying section, and the friction reducing layer is provided extending along the bend output section.

2. The spraying device as claimed in claim 1, wherein the material having a low friction coefficient is a polytetrafluoroethylene (PTFE) material.

3. The spraying device as claimed in claim 1, wherein the inner fluid transmission tube is made of a material having a low friction coefficient.

4. The spraying device as claimed in claim 1, wherein the friction reducing layer is a tube.

5. The spraying device as claimed in claim 1, wherein the friction reducing layer is a film coated on an internal surface of the outer fluid transmission tube.

6. The spraying device as claimed in claim 1, wherein a bump is formed on an internal surface of the outer fluid transmission tube for blocking an end portion of the friction reducing layer.

7. The spraying device as claimed in claim 1, wherein the friction reducing layer is provided extending along both the conveying section and the bend output section.

8. A spraying device comprising: an outer fluid transmission tube which is disposed in the spraying device and is rotatable with an axial of the spraying device; the outer fluid transmission tube being in fluid communication with a fluid input tube which is used for connecting to a fluid supplying source; and an inner fluid transmission tube, used for connecting to a fluid container, being disposed in the outer fluid transmission tube, wherein a friction reducing layer, made of a material having a low friction coefficient, is provided between the outer fluid transmission tube and the inner fluid transmission tube and is rotated together with the outer fluid transmission tube, and an inner wall surface thereof is formed as with a smooth surface, so as to make a friction force between the friction reducing layer and the inner fluid transmission tube lower;

wherein the outer fluid transmission tube has a conveying section and a bend output section connected with the conveying section, and the friction reducing layer is provided extending along both the conveying section and the bend output section.

* * * * *